United States Patent [19]

Hancock

[11] 3,948,120

[45] Apr. 6, 1976

[54] WRENCH

[76] Inventor: Paul D. Hancock, Rte. 2 Box 99A, Malvern, Ark. 72104

[22] Filed: Jan. 8, 1975

[21] Appl. No.: 539,345

[52] U.S. Cl. ..... 81/165; 81/170; 81/DIG. 5

[51] Int. Cl.[2] ..... B25B 13/16

[58] Field of Search..... 81/165, 170, 180 R, DIG. 5, 81/DIG. 8

[56] References Cited

UNITED STATES PATENTS

| | | | |
|---|---|---|---|
| 132,057 | 10/1872 | Cooper et al. | 81/170 X |
| 1,512,559 | 10/1924 | Moore | 81/165 |
| 2,600,617 | 6/1952 | Coates | 81/165 |
| 2,722,150 | 11/1955 | Green | 81/165 |
| 2,825,254 | 3/1958 | Peltcher | 81/165 |
| 2,850,932 | 9/1958 | Bonkowski | 81/165 X |
| 3,183,744 | 5/1965 | Bowman | 81/165 |
| 3,326,068 | 6/1967 | Lanzetta | 81/165 |

FOREIGN PATENTS OR APPLICATIONS

| | | | |
|---|---|---|---|
| 159,965 | 7/1957 | Sweden | 81/165 |
| 312,171 | 5/1919 | Germany | 81/165 |

*Primary Examiner*—Al Lawrence Smith
*Assistant Examiner*—James G. Smith
*Attorney, Agent, or Firm*—Andrus, Sceales, Starke & Sawall

[57] ABSTRACT

An improved wrench includes a wrench head having a fixed jaw and a sliding jaw. The head includes a square hole for receiving a mating projection on a wrench handle. The wrench handle may include a ratcheting mechanism. Means are provided to retain the sliding jaw in a desired position on the wrench head and to indicate the size of the jaw opening.

14 Claims, 4 Drawing Figures

WRENCH

SUMMARY

Slidable jaw wrenches, for example, those commonly termed "Crescent wrenches" possess infinite adjustability but must be repeatedly disengaged and reapplied to the nut, bolt, or other object to which torque is applied as the object rotates. The jaws of such wrenches are also prone to slippage both in the loaded and unloaded condition, requiring constant readjustment. It is also difficult to adjust such wrench to a preselected size other than by application to the nut.

Ratchet handle wrenches, on the other hand, enable the position of the handle to remain relatively constant as the nut rotates due to the relative rotation between the nut engaging socket of the wrench and the handle provided by the ratcheting action. However, the sockets used with ratchet wrenches are not infinitely variable but are available only in discrete sizes and increments. The depth of the socket may limit the amount by which a nut can be threaded on a bolt.

It is, therefore, the object of the present invention to provide an improved wrench which combines the advantageous features of both an adjustable sliding jaw wrench and a ratchet wrench. The jaws of the wrench are infinitely variable yet the handle may remain in the same relative position during operation of the wrench.

Other features of the wrench include an economical and reliable means for retaining the jaws of the wrench in a desired relative position thereby avoiding the need for continual readjustment to obtain proper engagement with the nut. The opening in the wrench may be precisely set prior to application to the nut.

Briefly, the present invention contemplates the provision of an improved wrench comprised of a wrench head and a handle. The wrench head has a fixed jaw and a sliding jaw and includes at least one square hole for receiving a mating projection on the wrench handle. The wrench handle may include a ratcheting mechanism. Means are provided to retain the sliding jaw in a desired position on the wrench head and to indicate the size of the jaw opening.

DESCRIPTION OF THE PREFERRED EMBODIMENT

Figure 1:
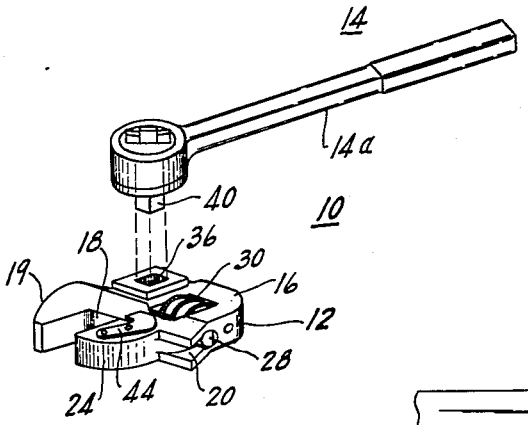
FIG. 1 is a perspective view of one embodiment of the improved wrench of the present invention.
Figure 2:
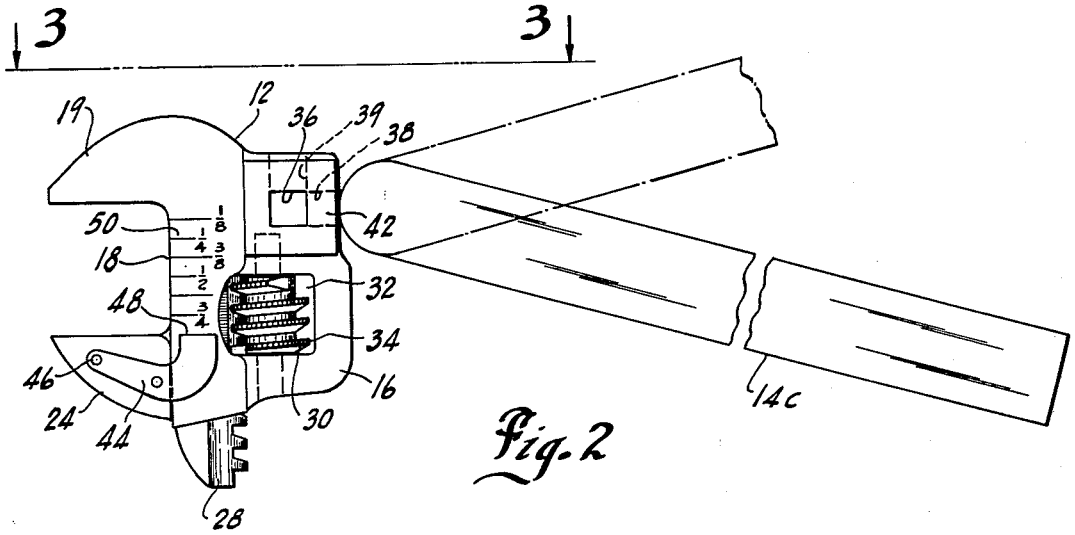
FIG. 2 is a plan view of another embodiment of the improved wrench of the present invention.

As shown in FIG. 1, the improved wrench 10 of the present invention includes wrench head 12 and wrench handle 14. Wrench head 12 includes a base 16 containing work surface 18, as shown in FIG. 2. A fixed jaw 19 extends from work surface 18 along one side of base 16.

Figure 4:
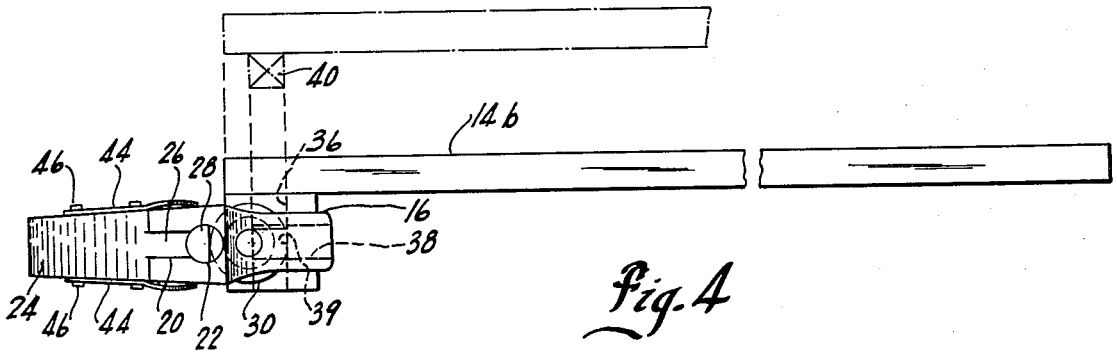
FIG. 4 is a side view of yet another embodiment of the improved wrench of the present invention.

As shown most clearly in FIG. 4, work surface 18 contains slot 20 terminating in the cylindrical cavity 22. Sliding jaw 24 includes flange 26 positioned in slot 20 and rod 28 positioned in cavity 22. The lower, or bottom, portion of rod 28 is formed as a rack.

The rack portion of rod 28 engages worm gear 30 which is rotatably mounted in opening 32 in base 16. The crest 34 of worm gear 30 is knurled to facilitate rotation of the worm gear with the thumb or fingers.

Wrench head 12 includes square hole 36 extending through base 16 from one surface thereof to the other. Wrench head 12 also includes a second hole 38 extending from the end of base 14 into hole 36 at right angles to hole 36 and a third hole 39 extending into hole 36 at right angles to hole 38 as shown in FIG. 2.

Figure 3:
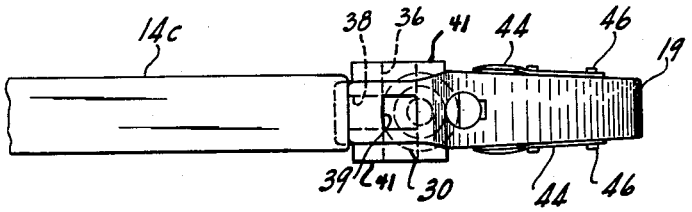
FIG. 3 is a side view of the wrench shown in FIG. 2 taken along the line 3—3.

A variety of handles 14 may be employed with wrench head 12. For example, the standard ratchet wrench handle 14*a* shown in FIG. 1, may be used, in which case hole 36 in base 16 may be sized to receive stud 40 of the ratchet wrench handle. The size of stud 40 is proportional to the size of wrench 10. Or, a non ratcheting wrench handle 14b containing stud 40 may be employed, as shown in FIG. 4. Wrench head 12 may include pads 41 shown most clearly in FIG. 3, which prevent interference between wrench handle 14 and worm gear 30. In the embodiment shown in FIGS. 2 and 3, stud 42 may be mounted on the end of bar 14c and inserted in holes 38 and 39.

In use, the wrench head 10 is adjusted to the desired size by moving sliding jaw 24 with knurled worm gear 30. The desired wrench handle 14 is coupled to wrench head 12. In the case of ratchet wrench handle 14a, stud 40 is placed in hole 36 and the ratcheting action of handle 14a adjusted for the tightening or loosening direction of rotation. The jaws of wrench head 12 are slipped over the nut and handle 14 is operated to provide the desired torque to the nut.

In instances in which a non ratcheting wrench handle 14b is employed, stud 40 is inserted in hole 36.

If bar 14c is used, stud 42 is inserted in hole 38 or 39 and the lever operated to provide the desired torque to the nut or other object. The mounting of stud 42 at an angle on wrench handle 14c provides a pair of torque applying positions for the handle in each of holes 38 and 39, as shown in FIG. 2 in connection with hole 38.

To hold sliding jaw 22 in the desired position, a pair of spring leaves 44 may be affixed to sliding jaw 24, as by rivets 46 to resiliently grip base 16 of wrench head 12. As shown most clearly in FIG. 2, spring leaves 44 may be arcuate, having an edge 48 terminating parallel with the edge of sliding jaw 24. The edge 48 of spring leaves 44 may be employed in conjunction with graduations 50 along work surface 18 to indicate the size of the opening between the jaws of wrench 10. This assists in adjusting the wrench prior to application of the wrench to the nut. It also permits use of the wrench as a nut and bolt size guage. In instances in which the sliding jaw wrench does not hold well enough to loosen the nut or for other reasons is inappropriate for the job, the indication of the spacing of wrench jaws 19 and 24 will help in selecting the correct socket or open end wrench to replace the sliding jaw wrench. One side of base 12 may contain graduations in inches while the other side may contain graduations in some other unit of measurement, such as metric.

Various modes of carrying out the invention are contemplated as being within the scope of the following claims particularly pointing out and distinctly claiming the subject matter which is regarded as the invention.

I claim:

1. An improved wrench comprising:

a wrench having a base including a fixed jaw and a work surface extending from said fixed jaw, said work surface having linear graduations in association therewith; an adjustable jaw slidable along said work surface; a pair of spring leaves, one of which is mounted on either side of said adjustable jaw and which extend below said jaw to resiliently grip said base for retaining said jaw in desired position along said work surface, said leaves coacting with said graduations for indicating the spacing between said jaws; said base including a socket means; and a wrench handle having means for engaging said socket means for transmitting rotational torque to said wrench head.

2. The improved wrench of claim 1 wherein said jaws have opposing edges oriented substantially perpendicular to said work surface and each of said spring leaves is generally arcuate, the portion embracing said base having an end terminating in an edge parallel to the edge of said sliding jaw for coaction with said graduations.

3. The improved wrench of claim 1 wherein said graduations include a pair of scales in association with said work surface graduated in different units of measurement.

4. The improved wrench of claim 3 wherein said scales are on opposite sides of said work surface and one of said spring leaves coacts with one of said scales and the other of said spring leaves coacts with the other of said scales.

5. The improved wrench of claim 1 wherein said base is generally flat and has a pair of substantially parallel surfaces and wherein said socket means includes a hole extending through said base from one surface to the other.

6. The improved wrench of claim 1 wherein said base is generally flat and has a pair of substantially parallel surfaces and wherein said socket means includes a first hole parallel to said surfaces and having one end opening on the exterior of said base for receiving said means on said wrench handle.

7. The improved wrench of claim 6 wherein said socket means includes a second hole parallel to said surfaces angularly disposed with respect to said first hole and having one end opening on the exterior of said base for receiving said means on said wrench handle.

8. The improved wrench of claim 2 wherein said socket means includes a second hole parallel to said surfaces and having one end opening on the exterior of said base for receiving said means on said wrench handle.

9. The improved wrench of claim 1 wherein said socket means comprises a square hole for receiving a square projection on said wrench handle.

10. The improved wrench of claim 9 wherein said wrench handle includes an elongated bar having a projection generally perpendicular to said bar.

11. The improved wrench of claim 10 wherein said wrench handle includes a ratcheting mechanism between said bar and said projection.

12. The improved wrench of claim 6 wherein said wrench handle includes an elongated bar having a projection on the end thereof.

13. The improved wrench of claim 12 wherein said projection is mounted at an angle to the axis of said elongated bar.

14. The improved wrench of claim 1 wherein said sliding jaw contains a rack and said base contains a worm gear engaging said rack for moving said jaw.

* * * * *

UNITED STATES PATENT AND TRADEMARK OFFICE

CERTIFICATE OF CORRECTION

PATENT NO. : 3,948,120

DATED : April 6, 1976

INVENTOR(S) : PAUL D. HANCOCK

It is certified that error appears in the above-identified patent and that said Letters Patent are hereby corrected as shown below:

Column 4, Line 12, after "claim" cancel "2" and insert --- 5 ---;

Signed and Sealed this

Nineteenth Day of October 1976

[SEAL]

*Attest:*

RUTH C. MASON
*Attesting Officer*

C. MARSHALL DANN
*Commissioner of Patents and Trademarks*